United States Patent [19]

Saita et al.

[11] 4,323,225

[45] Apr. 6, 1982

[54] CIRCULAR FLUORESCENT LAMP MANUFACTURING APPARATUS

[75] Inventors: Shigeaki Saita; Manabu Nakaoka, both of Ohme, Japan

[73] Assignee: Hitachi, Ltd., Tokyo, Japan

[21] Appl. No.: 155,161

[22] Filed: Jun. 2, 1980

[30] Foreign Application Priority Data

Aug. 24, 1979 [JP] Japan ..... 54-107263

[51] Int. Cl.[3] ..... B25B 1/20

[52] U.S. Cl. ..... 269/43; 269/63; 269/254 CS; 269/908; 29/25.19; 29/760

[58] Field of Search ..... 269/908, 71, 73, 254 CS, 269/43, 45, 55–57, 63; 29/25.19, 760

[56] References Cited

U.S. PATENT DOCUMENTS 4,054,772 10/1977 Lichte ..... 269/63

*Primary Examiner*—Robert C. Watson

*Attorney, Agent, or Firm*—Kenyon & Kenyon

[57] ABSTRACT

A circular fluorescent lamp manufacturing apparatus is constructed such that it can accomplish both the basing process and the seasoning process with the use of a single machinery according to the present invention. The lamp manufacturing apparatus is characterized in its head construction. The circular glass tube is based and seasoned by the two rotations of a turntable and by the four turns of 90 degrees of a paired circular glass tube supporters to be effected in that meanwhile so that the circular fluorescent lamps can be finished.

6 Claims, 4 Drawing Figures

CIRCULAR FLUORESCENT LAMP MANUFACTURING APPARATUS

BACKGROUND OF THE INVENTION

1. Field of the Invention

The present invention relates to a circular fluorescent lamp manufacturing apparatus, and more particularly to a head structure for use in a single machinery for accomplishing both the basing process and the seasoning process.

2. Description of the Prior Art

At present, the ratio of fluorescent lamps to the lighting goods used in general houses is remarkably high. Among them, circular fluorescent lamps are used at a high ratio. The manufacture of such circular fluorescent lamps includes as its final process a basing process for mounting a base in the gap between the ends of a glass tube which is formed into a circular shape and a seasoning process for lighting the lamp for a preset time so as to stabilize the lamp characteristics. Generally speaking, those two processes have conventionally been performed with the use of respective special machineries. And, it is the actual circumstances that the inter-processes, i.e., the unloading and loading of the special machineries from and with the annular glass tube resort wholly to the manual operations. As a result, the conventional manufacture cannot be free from the difficulties such as the time waste accompanying the transportation of the annular glass tube, the increase in the number of workers and the reduction in working efficiency due to the separate operations and accordingly raises the production cost of the lamps.

SUMMARY OF THE INVENTION

It is therefore an object of the present invention to provide a circular fluorescent lamp manufacturing apparatus which can accomplish both the basing process and the seasoning process in a single machinery while eliminating the afore-mentioned problem.

In order to attain the above object, there is provided according to the present invention a circular fluorescent lamp manufacturing apparatus which comprises a turntable made intermittently rotatable at a fixed pitch, a plurality of bearing supporters equi-distantly arranged on the outer circumferential part of said turntable, a rotary shaft attached to each of said bearing supporters, a pair of circular glass tube supporters arranged in parallel through said rotary shaft and mounted at their centers on said rotary shaft, holding means for holding a circular glass tube on each of said circular glass tube supporters, and rotating means for intermittently rotating said circular glass tube supporters about said rotary shaft.

According to the characteristic construction of the present invention, by the two rotations of the turntable and by the four rotations of the circular glass tube supporters to be effected at each right angle in that meanwhile after the loading operation of the circular glass tube supporters with the annular glass tubes, a base is mounted on each of the annular glass tubes, and this glass tube is subjected to the seasoning treatment so that a finished annular fluorescent lamp can be produced. As a result, the workability and mass-productivity are so improved that a circular fluorescent lamp can be manufactured at a low cost.

DESCRIPTION OF THE PREFERRED EMBODIMENT

Figure 1:
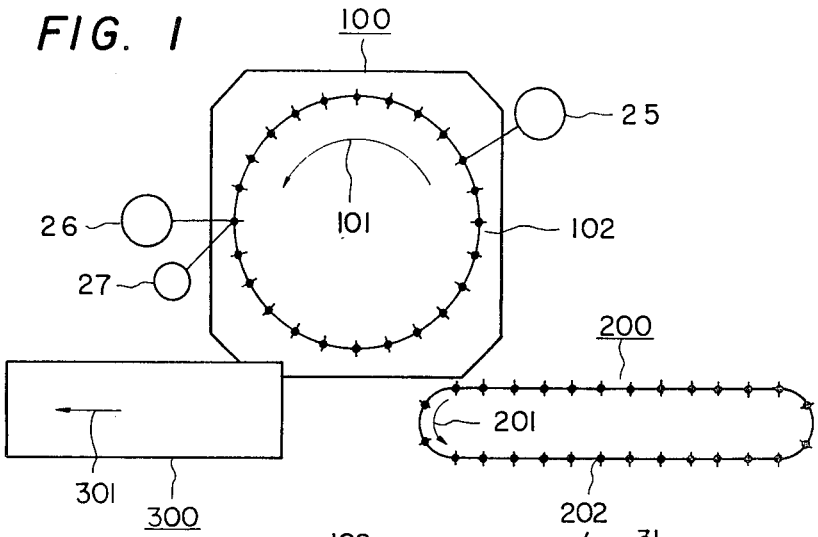
FIG. 1 is a diagrammatical view showing the construction of a circular fluorescent lamp manufacturing apparatus according to the present invention.

FIG. 1 shows the overall construction of a circular fluorescent lamp manufacturing apparatus according to the present invention. In FIG. 1, the circular fluorescent lamp manufacturing apparatus 100 is loaded with circular glass tubes from a hanger conveyor 200 which is made operative to accomplish the transportation of the circular fluorescent lamps and the previous forming of lead wires. Then, the manufacturing apparatus 100 mounts bases on the circular glass tubes and seasons the circular glass tubes so that the circular fluorescent lamps are finished. After that, the fluorescent lamps thus finished are unloaded from the lamp manufacturing apparatus 100 to an unload conveyor 300 which is operative to transport the circular fluorescent lamps. As will be described hereinafter in detail, the circular fluorescent lamp manufacturing apparatus 100 is equipped with twenty four rotary heads 102 which are mounted on the turntable so that it consecutively accomplishes, in accordance with a preset head schedule, the straightening process of the lead wires, the basing process (wherein the upper and lower bases are fed by base feeders 25 and 26), the screw-driving process (wherein the screws are fed by feeders 27), the cutting process of the excess lead wires, the soldering process and the seasoning process, as the turntable intermittently rotates in the direction indicated at arrow 101, so that one circular fluorescent lamp is completed during the two rotations of the turntable. On the other hand, the hanger conveyor 200 is equipped with twenty eight heads 202 so that it transports the circular glass tubes while rotating in the direction indicated at arrow 201. Moreover, the unload conveyor 300 is made of a rubber belt so that it transports the completed circular fluorescent lamps to the subsequent process, e.g., the packing process while advancing in the direction indicated at arrow 301.

Figure 2A:
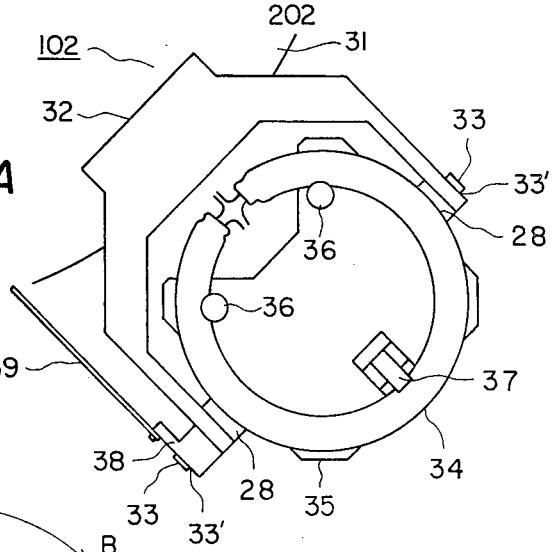
FIGS. 2A and 2B are detailed views showing construction of a rotary head for use in the manufacturing apparatus shown in FIG. 1.
Figure 2B:
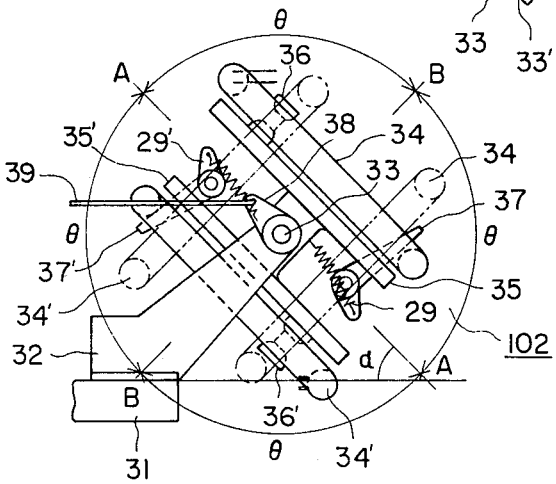

Now, the detail of the rotary head 102 constituting the most characteristic portion of the circular fluorescent lamp manufacturing apparatus 100 according to the present invention will be described with reference to FIGS. 2A and 2B. In FIGS. 2A and 2B illustrating the overall construction of the rotary head 102, the former is a top plan view of the same, whereas the latter is a side elevation of the same. As shown in FIGS. 2A and 2B, twenty four bearing supporters 32 are equi-distantly arranged on the outer circumferential part of a turntable 31 which is made intermittently rotatable at a fixed pitch. Each of the bearing supporters 32 is bifurcated at its other ends, on which bearings 33' and 33' are mounted, respectively. Rotary shafts 33 and 33 are fitted in the bearings 33' and 33', respectively. A pair of circular glass tube supporters 35 and 35' are arranged in parallel at the both sides of the rotary shafts 33 and 33 and in a back-to-back relationship. Those tube supporters 35 and 35' are jointed to each other by means of boss members 28 and 28, which in turn are fixed to the rotary shafts 33 and 33, respectively. There are fixedly held on the circular glass tube supporters 35 and 35' two circular glass tubes 34 and 34' by means of two V-shaped rollers 36, 36, 36' and 36' and chuck levers 37 and 37'. By the tension springs 29 and 29' which are connected to the respective ends of the chuck levers 37 and 37', pressures are always applied to the other ends of the chuck levers 37 and 37' and further to the circular glass tubes 34 and 34' so that these glass tubes are fixedly held in position by the pressures and by the actions of the two V-shaped rollers 36, 36, 36' and 36'. A lever 38 is fixed to one of the rotary shafts 33 and 33. And the lever 38 has its other end connected to a connecting rod 39. To the other end of this connecting rod 39, there is further connected a (not-shown) turning unit, e.g., a lever which is fixed to a cam-rail. As has been described hereinbefore, the paired circular glass tube supporters 35 and 35', which are fixed to the rotary shafts 33 and 33 by means of the boss members 28 and 28, are so constructed that they can be turned by the turning mechanism which is composed of the lever 38, the connecting rod 39 and the turning unit. More specifically, the paired circular glass tube supporters 35 and 35' are constructed to have four stop positions so that they are turned a preset angle by the turning mechanism each time the turn table 31 intermittently rotates to bring the head 102 to a preset head position. Here, the first stop position of the supporters 35 and 35' is a position, in which the circular glass tubes 34 and 34' are shown in solid lines in FIG. 2B. In other words, the first stop position is a position, in which the angle of intersection $\alpha$ between the extension of the line A—A extending through the rotary shaft 33 in parallel with the planes of the supporters 35 and 35' coaxially arranged in parallel with each other and the extension of the line extending in parallel with the plane of the turntable 31 is 45 degrees. A second stop position is a position, in which the supporters 35 and 35' are placed to have the circular glass tubes 34 and 34' under the condition shown in phantom lines in FIG. 2B. More specifically, the second stop position is a position, in which the planes of the supporters 35 and 35' exist in parallel with the line B—B intersecting the line A—A at a right angle, i.e., which is turned clockwise by an angle $\theta=90$ degrees from the first stop position. On the other hand, a third stop position is a position which is further turned clockwise by the angle $\theta=90$ degrees from the second stop position and by the angle of 180 degrees from the first stop position so that the supporters 35 and 35' are just under inverted positions. Moreover, a fourth stop position is a position which is further turned clockwise by the angle $\theta=90$ degrees from the third stop position and by the angle of 180 degrees from the second stop position so that the supporters 35 and 35' have just opposite positional relationships.

Thus, while the (positive or negative) angle between the line in parallel with the plane of the turntable 31 and the line in parallel with the planes of the supporters 35 and 35' being maintained at 45 degrees at all times, the turntable 31 rotates in an intermittent manner, and the supporters 35 and 35' are turned by 90 degrees at each preset head position so that the afore-mentioned respective processes including the straightening process of the lead wires, the basing process, the screw-driving process, the soldering process and the seasoning process are consecutively effected thereby to finish the circular fluorescent lamps. Here, it should be noted that the center of the circular glass tube 34 on the supporter 35 and the center of the circular glass tube 34' on the supporter 35' are made eccentric in the opposite directions to each other. This is because the head or the like of the basing machine is enabled to approach the gap between the ends of each circular glass tube without any difficulty.

Figure 3:
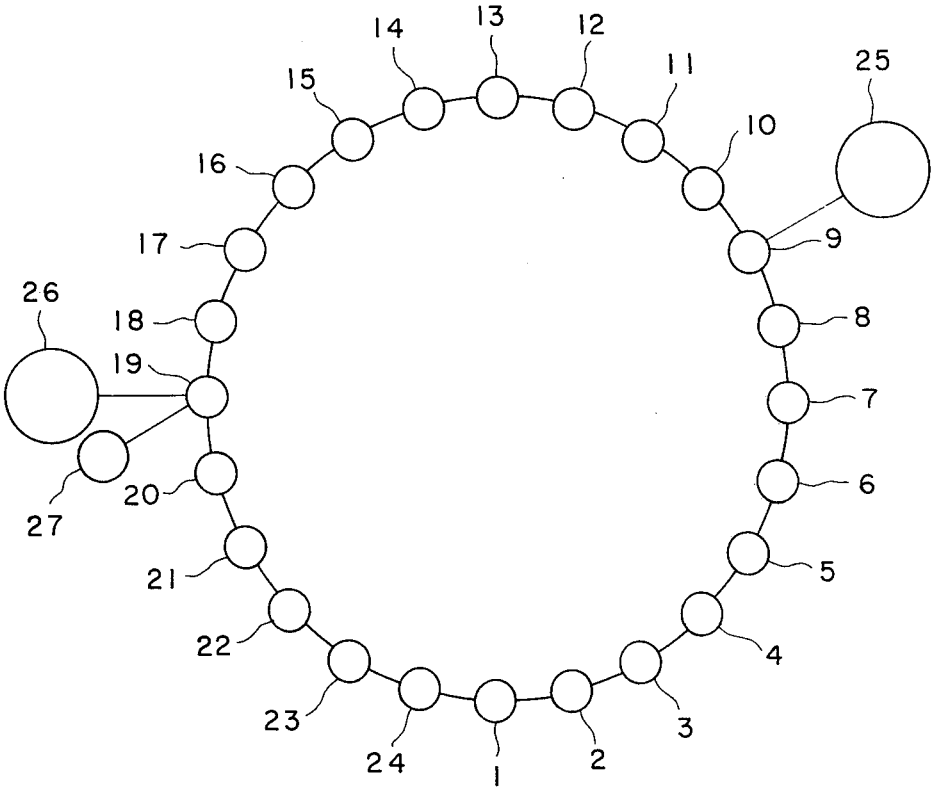
FIG. 3 is an explanatory view illustrating the operations of the manufacturing apparatus shown in FIG. 1.

What head schedule is followed to automatically accomplish the afore-mentioned respective processes by the circular fluorescent lamp manufacturing apparatus 100 which is equipped with the twenty four rotary heads 102, as has been described in detail with reference to FIGS. 2A and 2B, will now be described in detail in connection with both the time schedule shown in FIG. 3 and the four stop positions of the supporters 35 and 35' shown in FIGS. 4A to 4D. In FIG. 3, the stop positions of the rotary heads 102 of the circular fluorescent lamp manufacturing apparatus 100 shown in FIG. 1 are indicated at circles, which are designated at index numbers in accordance with the orders of the stop positions. In FIGS. 4A, 4B, 4C and 4D, on the other hand, the four stop positions described with reference to FIGS. 2A and 2B are illustrated in concrete forms. The details of the processes at each stop position will be described in the following in a manner to correspond to the head schedules.

Figure 4A:
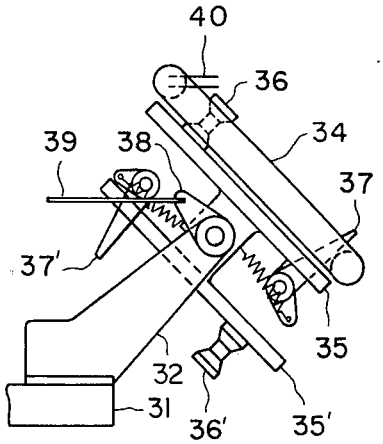
FIGS. 4A to 4D are views illustrating the operations of the rotary head shown in FIGS. 2A and 2B.

(1) Processes at first stop position shown in FIG. 4A:

The supporter 35 is loaded at positions 1 and 2 with the circular glass tube 34, which is fixedly held thereon by means of the two V-shaped rollers 36 and 36 and the chuck lever 37. At positions 3 to 7, then, the four lead wires 40 protruding into the gap between the ends of the circular glass tube 34 are straightened. On the other hand, although the orders of the processes are inverted, the circular fluorescent lamp which has been finished at a position 23 is unloaded at those positions. A position 24 is a no-load position. At a next position 8, turn of 90 degrees is effected to take the second stop position shown in FIG. 4B.

Figure 4B:
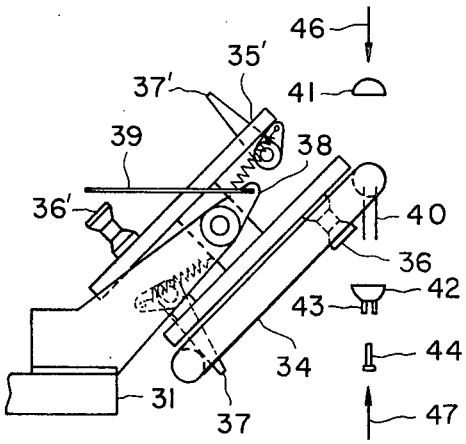

(2) Processes at second stop position shown in FIG. 4B:

At positions 9 to 11, a lower base 42 having four pins 43 is fed in the direction indicated at arrow 47 from the base feeder 25. Then, the respective lead wires 40 are inserted into the pins 43 and are extracted so that they are detected after the lower base 42 is advanced to a preset position. After having passed through a no-load position 12, the excess lead wires are cut at positions 13 and 14. Flux is applied at a position 15 so that the soldering process may be effected at positions 16 and 17 while applying the solder. After having passed through a no-load position 18, an upper base 41 and a screw 44 are fed at a position 19 from the upper base feeder 26 and the screw feeder 27, respectively, in the directions indicated at arrows 46 and 47. At that position, the upper and lower bases 41 and 42 are fixed by means of the screw 44, and the (not-shown) lower base receptacle supporting the lower base 42 is moved down at a position 20. A position 21 is a no-load position. At a next position 22, turn of 90 degrees is effected to take the third stop position shown in FIG. 4C.

Figure 4C:
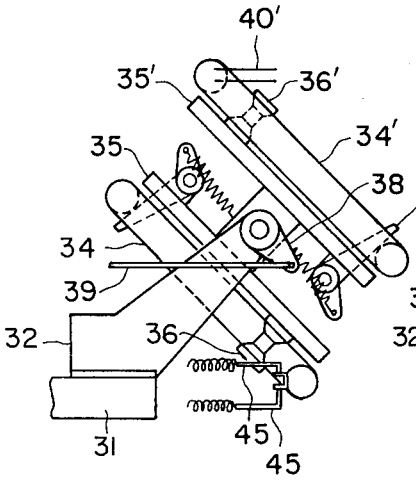

(3) Processes at third stop position shown in FIG. 4C:

At positions 23 to 7, the pins 43 of the circular glass tube 34 held on the supporter 35 are connected with electrodes 45 and 45 so that the tube 34 may be lit by the power supply and subjected to the seasoning process.

At the positions 1 and 2, on the other hand, the other supporter 35' is loaded with the other circular glass tube 34', which is then fixedly held by means of the two V-shaped rollers 36' and 36' and the chuck lever 37'. At the positions 3 to 7, moreover, the four lead wires 10' of the circular glass tube 34' are straightened. At the next position 8, another turn of 90 degrees is effected to take the fourth stop position shown in FIG. 4D.

Figure 4D:
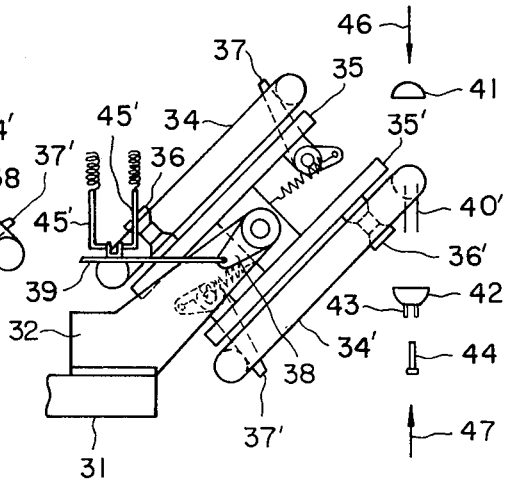

(4) Processes at fourth stop position shown in FIG. 4D:

At the positions 9 to 14, the pins 43 of the circular glass tube 34 held on the supporter 35 are connected again with other electrodes 45' and 45' so that the tube 34 may be lit by the power supply and subjected to the seasoning process. On the other hand, the circular glass tube 34' on the supporter 35' is subjected to the same subsequent processes as those of the circular glass tube 34 at the second stop position, and their repeated explanations are omitted here.

The circular fluorescent lamp 34 finished after having been subjected to the seasoning process at the position 14 passes through the positions 15 to 17 without any process until it is lit and selected at the positions 18 to 21. After that, at the position 22, another turn of 90 degrees is effected to restore the afore-mentioned first stop position shown in FIG. 4A. At this particular stop position, the finished circular fluorescent lamp 34 is unloaded at the position 23, as has been described in connection with the first stop position. On the other hand, the circular glass tube 34' on the supporter 35' is subjected to the afore-mentioned seasoning process at the above third stop position. The circular glass tube 34' is then unloaded so that another circular glass tube 34 is fixedly held upon the supporter 35 now emptied. In the following, the first to fourth stop positions thus far described are likewise taken in a repeated manner so that the preset processes are effected at each stop position thereby to consecutively finish the circular fluorescent lamps.

As has been described hereinbefore, in the circular fluorescent lamp manufacturing apparatus according to the present invention, the respective basing and seasoning processes are terminated by the four turns of 90 degrees and by the two turns of the turntable after the supporters are loaded with the circular glass tubes so that the desired circular fluorescent lamps are manufactured. Moreover, since one of the paired supporters effects the basing process whereas the other effects the seasoning process, it is possible to effectively enlarge the working space to a remarkable extent. As a result, the workability and mass-productivity are accordingly improved so that the production cost of the circular fluorescent lamps can be considerably reduced.

What is claimed is:

1. A circular fluorescent lamp manufacturing apparatus comprising: a turntable supported for intermittent rotation at a fixed pitch; a plurality of bearing supporters bi-furcated at their outer ends, each outer end containing a bearing, said bearing supporters equi-distantly arranged on the outer circumferential part of said turntable; a rotary shaft means supported for rotation in said bearings between said bi-furcated outer ends in each bearing supporter; a pair of circular glass tube supporters arranged in parallel back to back and joined to each of said rotary shaft means so as to be rotable therewith; holding means for holding a circular glass tube on each of said circular glass tube supporters; and rotating means for intermittently rotating each of said rotating shafts in its bearings to thereby rotate said circular glass tube supporters through a plurality of stop positions.

2. A circular fluorescent lamp manufacturing apparatus as set forth in claim 1 and further comprising means to turn the glass tube supporters once for each two rotations of the turntable.

3. A circular fluorescent lamp manufacturing apparatus as set forth in claim 1, wherein said means for intermittently rotating each of said rotary shafts are adapted to rotate intermittently said rotary shafts at a pitch of 90°, through said plurality of stop positions.

4. A circular fluorescent lamp manufacturing apparatus as set forth in claim 1, wherein the planes of said circular glass tube supporters at at least one stop position are inclined at 45 degrees with respect to the rotary plane of said turntable.

5. A circular fluorescent lamp manufacturing apparatus as set forth in claim 1, wherein said holding means includes V-shaped rollers and a chuck lever mounted on said circular glass tube supporters.

6. A circular fluorescent lamp manufacturing apparatus as set forth in claim 1, wherein said rotating means includes a lever fixed to said rotary shaft, and a connecting rod connected between the end portion of said lever and a source of turning power.

* * * * *